US007152830B2

(12) United States Patent
Dowell et al.

(10) Patent No.: US 7,152,830 B2
(45) Date of Patent: Dec. 26, 2006

(54) SWITCH MACHINE IMPROVEMENTS

(75) Inventors: John Patrick Dowell, Grove City, PA (US); Charles David Crawford, Blue Springs, MO (US); Maurizio Biagiotti, Pisa (IT); Michael Lee Ashton, Lee's Summit, MO (US); Edward Armand Croteau, Lee's Summit, MO (US); Wallace Martindell Catanach, III, Grain Valley, MO (US)

(73) Assignee: General Electric Companyy, Schenectady, NY (US)

( * ) Notice: Subject to any disclaimer, the term of this patent is extended or adjusted under 35 U.S.C. 154(b) by 0 days.

(21) Appl. No.: 11/005,894

(22) Filed: Dec. 6, 2004

(65) Prior Publication Data

US 2005/0236526 A1 Oct. 27, 2005

Related U.S. Application Data

(60) Provisional application No. 60/564,826, filed on Apr. 23, 2004.

(51) Int. Cl.
*A63H 19/32* (2006.01)

(52) U.S. Cl. ..... 246/415 R; 246/406; 246/407

(58) Field of Classification Search ..... 246/415 R, 246/369, 405, 406, 407, 393; 74/89.23, 89.29, 74/89.37, 625; 192/141, 142 R
See application file for complete search history.

(56) References Cited

U.S. PATENT DOCUMENTS

| | | | | |
|---|---|---|---|---|
| 2,641,690 | A * | 6/1953 | McLeish | 246/240 |
| 2,986,630 | A * | 5/1961 | Maynard | 246/240 |
| 3,470,371 | A * | 9/1969 | Hayes | 246/163 |
| 4,150,769 | A * | 4/1979 | James | 222/137 |
| 4,266,437 | A * | 5/1981 | Obergfell | 74/89.37 |
| 4,380,325 | A * | 4/1983 | Palmer | 251/14 |
| 4,413,983 | A * | 11/1983 | Young et al. | 493/30 |
| 4,741,221 | A * | 5/1988 | Hudimac, Jr. | 74/424.9 |
| 5,094,114 | A * | 3/1992 | Date et al. | 74/89.36 |
| 6,454,221 | B1 * | 9/2002 | Bonfigli | 246/415 R |

* cited by examiner

*Primary Examiner*—Frantz F. Jules
(74) *Attorney, Agent, or Firm*—Gerald W. Spinks

(57) ABSTRACT

A control mechanism for moving switch points on a railroad track, having a drive screw driven by a motor, a traveling block moving along the drive screw to position the switch points, an end stop on the drive screw for limiting movement of the traveling block, a hand crank for manually turning the drive screw, and a torque limiting clutch on the hand crank.

3 Claims, 1 Drawing Sheet

SWITCH MACHINE IMPROVEMENTS

CROSS REFERENCE TO RELATED APPLICATIONS

This application claims the benefit of U.S. Prov. App. No. 60/564,826, filed Apr. 23, 2004, for "Switch Machine Improvements".

STATEMENT REGARDING FEDERALLY SPONSORED RESEARCH OR DEVELOPMENT

Not Applicable

BACKGROUND OF THE INVENTION

1. Field of the Invention

This invention is in the field of equipment used to move switch points on a rail line, to direct movement of a rail vehicle along one track or another.

2. Background Art

Where two tracks of a rail line merge into a single track, it is necessary to have a switching mechanism to select which of the two merging tracks is to be aligned with the single track, for the desired routing of rail vehicles. Such a switching mechanism accomplishes this by moving a pair of rail ends called switch points, so that the two rails of the single track align with the two rails of one or the other of the two merging tracks. The switching mechanism can be driven by a reversible electric motor, which moves an operating rod or push rod linearly, in a direction transverse to the track rails, to move the switch points. The rotary motion of the electric motor shaft can be converted to this linear motion of the push rod by turning a threaded screw member, along which a traveling nut or block of some kind moves. As the traveling nut or block moves linearly along the screw member, it moves the push rod, to move the switch points. In addition to moving the switch points, the traveling nut will often incorporate a mechanism for de-energizing the motor at the ends of its travel, or for reversing the motor direction at those end points.

In addition to the electric motor, it is possible to provide a manual or emergency means for moving the switch points, in the event of a motor failure or a power failure. One type of manual mechanism for accomplishing this emergency switching operation is a hand crank mounted to the motor assembly. The hand crank can drive the threaded screw member, to move the traveling nut linearly along the screw member.

Such a switching mechanism must have durable components arranged in a robust construction, in order to withstand the heavy loads experienced by the rails and the attendant vibration, as well as surviving in the dirty, moist environment typically found along railroad tracks. Substantial forces are typically required to move the switch points, and the switching mechanism must reliably generate those forces without malfunction.

BRIEF SUMMARY OF THE INVENTION

The present invention includes, by way of example, a switch mechanism which incorporates a reversible electric motor driving a threaded screw via a gear train. The threaded screw can be of the ball drive type, in which the screw threads are contoured to receive a plurality of balls within a traveling block. The balls are constrained in position within the traveling block, and the block is constrained by a guiding surface to travel only in a linear fashion, parallel to the screw. As the ball drive screw turns, the balls rotate within the traveling block and roll along the screw thread. Since the traveling block is constrained to travel only in a linear fashion, parallel to the screw, the balls move linearly along the screw and push the traveling block along with them.

The traveling block is attached to a push rod, which is in turn attached to the switch points. As the traveling block moves linearly along the ball drive screw, the push rod is moved linearly, to move the switch points. As the traveling block reaches one of the end points of its travel along the ball drive screw, it contacts an electrical limit switch. Contact between the traveling block and the electrical limit switch actuates the electrical limit switch to de-energize the motor or to reverse the direction of the motor, or both. When the electrical limit switch is actuated, the rotation of the ball drive screw is stopped or reversed, preventing the traveling block from going past its desired end point of travel. A mechanical end stop is mounted to the ball drive screw, to physically stop the movement of the traveling block at a point slightly beyond its desired end point, in the event that actuation of the electrical limit switch fails to stop or reverse the motor for some reason. The end stop can be mounted on the ball drive screw with a fastener having a thread direction opposite the thread direction of the ball drive screw, preventing any possibility that the fastener could be unthreaded by friction between the traveling block, the end stop, and the fastener.

A hand crank is mounted to the housing of the motor assembly, for optional manual operation of the switch machine. The hand crank handle turns a shaft which drives a bevel gear, and the bevel gear meshes with the gear train through which the electric motor drives the ball drive screw. In the event that the motor is inoperable, the hand crank can be turned manually by an operator, to move the switch points and manually configure the track to re-route a rail vehicle. Since the electrical limit switch has no effect on the operation of the hand crank, it is desirable to prevent the operator from manually driving the traveling block against the end stop with sufficient force to damage the mechanism. A torque limiting clutch mechanism is therefore incorporated in the hand crank shaft between the handle and the bevel gear. This clutch mechanism is set to slip at a desired level of torque, to prevent the traveling block from being driven against the end stop with a force greater than a desired level of force.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
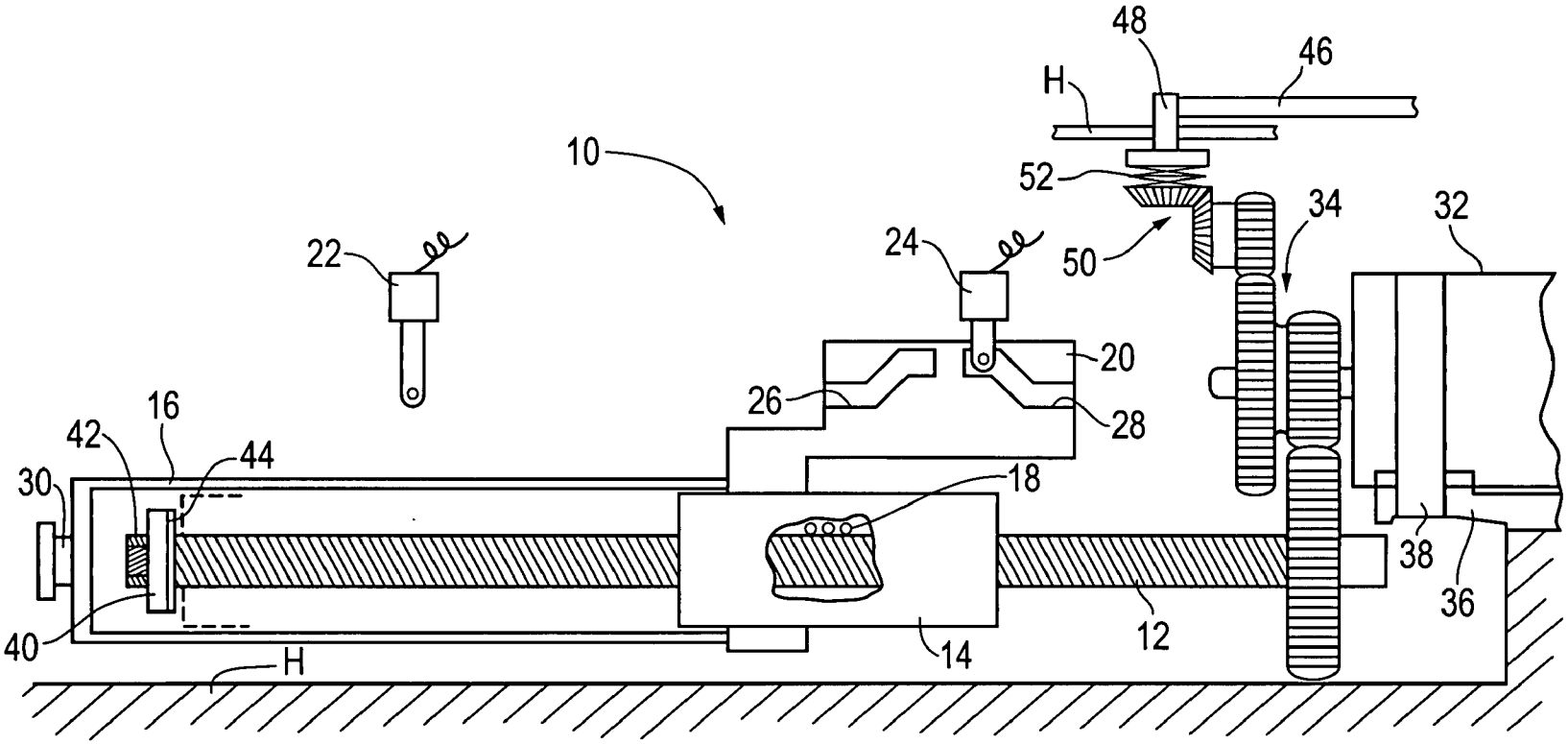
FIG. 1 is a schematic view of the switch machine control apparatus of the present invention.

As shown in FIG. 1, the apparatus 10 of the present invention includes a drive screw 12, a traveling block 14 mounted on the drive screw 12, and a push rod 16 attached to the traveling block 14, all mounted within a housing H. A plurality of drive balls 18 are constrained within the traveling block 14, and positioned to ride in the thread of the drive screw 12. A tripping arm 20 is mounted to the traveling block 14, with cam slots 26, 28 formed in the tripping arm 20. The cam slots 26, 28 are aligned with two electrical limit switches 22, 24. As shown in the Figure, the right limit switch 24 is within the right cam slot 28. A drive fitting 30 is formed on the end of the push rod 16, for attachment to the shifting and locking mechanism (not shown) of the switch machine, and ultimately to the switch points (not shown).

A reversible electric motor 32 is also mounted within the housing H, and drivably connected to a gear train 34, which drives the drive screw 12. The motor 32 is supported by the housing H, or a bracket within the housing, and it can be further supported by a cantilevered support block 36, to which the motor 32 can be strapped with a mount strap 38. The cantilevered support block 36 can be oriented as shown, to support the drive end of the motor 32, or it can be oriented toward the other end of the motor 32, depending upon which end of the motor 32 is otherwise supported from the housing H. Supporting the motor 32 at both ends in this way can prevent motor torque from causing misalignment with the gear train 34 and any resultant malfunction. The control circuit of the motor 32 includes the limit switches 22, 24.

The traveling block 14 is shown at its rightmost position in FIG. 1. The leftmost position of the traveling block 14 is represented by the dashed line near the left end of the drive screw 12. It can be seen that, as the drive screw 12 is turned by the motor 32, the traveling block 14 will move to the left until the left limit switch 22 enters the left cam slot 26 and moves to the upper end of the cam slot 26. As the traveling block 14 moves, the push rod 16 moves to the left along with it. At this point, the left limit switch 22 de-energizes the motor 32 and stops the traveling block 14 at the position indicated by the dashed line. The left limit switch 22 can also be used to reverse the direction of rotation of the motor 32, so that when the motor 32 is next energized, it will turn the drive screw 12 in the opposite direction.

An end stop 40 is provided at the left end of the drive screw 12, to physically stop the leftward movement of the traveling block 14 if necessary, preventing the traveling block 14 from being completely unthreaded from the end of the drive screw 12. This end stop 40 is particularly required in the event of manual operation of the apparatus 10, since the left limit switch 22 will have no effect on stopping the leftward movement of the traveling block 14, in that event. The end stop can be a disk or washer held in place by a fastener such as a stop nut 42 threaded on the end of the drive screw 12. The nut 42 can have a thread direction opposite to the thread direction of the drive screw 12, to prevent friction between the traveling block 14 and the end stop 40 from unthreading the stop nut 42. A washer 44 of relatively soft, low friction material such as a plastic can also be provided between the traveling block 14 and the end stop 40, to further prevent the possibility of loosening of the stop nut 42 or damage to the end stop 40.

Manual operation of the apparatus 10 is made possible by a hand crank handle 46 which turns a hand crank shaft 48, which can selectively turn the gear train 34 to drive the drive screw 12. The hand crank handle 46 is on the outside of the housing H, making it accessible to an operator, with the shaft 48 penetrating the housing H. The hand crank handle 46 could incorporate a ratchet mechanism, as is known in the art, or the handle 46 could actually be a hand wheel or any other manual operating device. The shaft 48 is shown turning the gear train 34 via the meshing of a bevel gear set 50, but the drivable connection between the shaft 48 and the drive screw 12 can be by any means known in the art.

It can be seen that, if the motor 32 fails to turn the drive screw 12 for some reason, the drive screw 12 can be selectively driven manually by turning the hand crank handle 46. As mentioned above, during this manual operation, it is possible for the operator to drive the traveling block 14 all the way against the end stop 40. In fact, depending upon the design of the gear train 34, it may be possible for the operator to unwittingly overstress the mechanism and damage the end stop 40 and even the drive screw 12. The drive screw 12 may be designed for a maximum tensile stress of about 8900 pounds, for example, and the hand crank apparatus may be capable of considerably more stress on the drive screw. For this reason, a torque limiting clutch 52 is provided on the hand crank shaft 48, to limit the torque which the operator can apply to the gear train 34 and in turn to the drive screw 12, to impose, for example, a maximum of 7000 pounds stress on the drive screw. That is, as the torque applied to the clutch 52 rises to a selected level, the clutch 52 will begin slipping, thereby limiting the applied torque to a level below the level which might cause harm to the remainder of the mechanism.

While the particular invention as herein shown and disclosed in detail is fully capable of obtaining the objects hereinbefore stated, it is to be understood that this disclosure is merely illustrative of the preferred embodiments of the invention.

We claim:

1. A control mechanism for a railroad switch machine, comprising:

a motor;

a drive screw selectively driven by said motor;

a hand crank adapted to selectively drive said drive screw;

a traveling block on said drive screw, said traveling block being connected to at least one push rod for relocating at least one switch point;

at least one limit switch adapted to be contacted by said traveling block at a selected point in its travel, to perform switching of said motor;

an end stop mounted to said drive screw for limiting movement of said traveling block beyond said at least one limit switch; and a torque limiting clutch connected to said hand crank, said clutch being adapted to limit torque applied to said drive screw by said hand crank, when said traveling block abuts said end stop.

2. The control mechanism recited in claim 1, further comprising a stop nut threaded on said drive screw, said stop nut being adapted to retain said end stop in position on said drive screw.

3. The control mechanism recited in claim 2, wherein said stop nut is threaded in a direction opposite the direction of threading of said drive screw.

* * * * *